US010543894B2

(12) United States Patent
Martin

(10) Patent No.: US 10,543,894 B2
(45) Date of Patent: Jan. 28, 2020

(54) SELF-POWERED STANDUP PERSONAL WATERCRAFT

(71) Applicant: William F. Martin, Boca Raton, FL (US)

(72) Inventor: William F. Martin, Boca Raton, FL (US)

( * ) Notice: Subject to any disclaimer, the term of this patent is extended or adjusted under 35 U.S.C. 154(b) by 0 days.

(21) Appl. No.: 16/356,715

(22) Filed: Mar. 18, 2019

(65) Prior Publication Data

US 2019/0283851 A1 Sep. 19, 2019

Related U.S. Application Data

(60) Provisional application No. 62/644,136, filed on Mar. 16, 2018.

(51) Int. Cl.

| | |
|---|---|
| ***B63H 16/18*** | (2006.01) |
| ***B63B 1/12*** | (2006.01) |
| *B63H 16/08* | (2006.01) |
| *B63H 16/20* | (2006.01) |
| *B63H 23/06* | (2006.01) |

(52) U.S. Cl.

CPC ..... *B63H 16/18* (2013.01); *B63B 1/121* (2013.01); *B63H 16/12* (2013.01); *B63H 16/20* (2013.01); *B63H 23/06* (2013.01); *B63H 2016/185* (2013.01); *B63H 2016/202* (2013.01)

(58) Field of Classification Search

CPC ..... B63H 16/18; B63H 16/12; B63H 16/20; B63H 23/06; B63H 2016/185; B63H 2016/202; B63B 1/121

See application file for complete search history.

(56) References Cited

U.S. PATENT DOCUMENTS

| | | | | |
|---|---|---|---|---|
| 3,084,356 | A | 4/1963 | Wheat | |
| 3,242,898 | A * | 3/1966 | Livaudais | B63B 35/83 441/77 |
| 3,695,211 | A | 10/1972 | Gross | |
| 4,541,809 | A | 9/1985 | Schaumann | |
| 4,591,343 | A | 5/1986 | Schaumann | |
| 5,194,023 | A | 3/1993 | Stone | |
| 7,607,959 | B2 | 10/2009 | DeMint | |
| 8,043,134 | B2 | 10/2011 | Krah | |
| 10,124,869 | B1 * | 11/2018 | Bailey | B63H 16/08 |

(Continued)

*Primary Examiner* — Stephen P Avila
(74) *Attorney, Agent, or Firm* — Robert M. Downey, P.A.

(57) ABSTRACT

A watercraft includes left and right hull members that are held in spaced apart, parallel relation by a supporting frame structure. A pendulum propulsion assembly mounts to the frame structure, between the hull members, and includes left and right pendulum assemblies that are each movable in a forward and rear direction by the operator's arms and legs. Each pendulum assembly includes at least a forward pendulum member extending through an upper pivotal connection to a lower pivot element coupled to a horizontal pendulum plane. A paddle holder mounted below the pendulum plane supports an arrangement of spaced paddles. Operation of the left and right pendulum assemblies in the forward and reverse alternating action through a normal stride causes the paddles to propel the watercraft in a forward direction. Forward flexing of the paddles in the power stroke is limited by tethers connecting between the paddles and the paddle support.

6 Claims, 5 Drawing Sheets

(56) References Cited

U.S. PATENT DOCUMENTS

| | | | | |
|---|---|---|---|---|
| 2008/0289554 | A1* | 11/2008 | Sturm | B63B 7/085<br>114/102.15 |
| 2013/0231014 | A1* | 9/2013 | Knutson | B63H 16/00<br>440/21 |
| 2016/0059945 | A1* | 3/2016 | Arad | B63H 5/15<br>440/23 |
| 2016/0214452 | A1* | 7/2016 | Dovel | B60F 3/0007 |
| 2017/0043637 | A1* | 2/2017 | Dovel | B60F 3/003 |

* cited by examiner

SELF-POWERED STANDUP PERSONAL WATERCRAFT

This non-provisional patent application is based on provisional patent application Ser. No. 62/644,136 filed Mar. 16, 2018.

BACKGROUND OF THE INVENTION

Field of the Invention

The present invention relates to human powered watercraft and, more particularly, to a watercraft that is powered by the operator while in a standing position by moving left and right pendulum assemblies in a forward and reverse alternating action that follows a natural gait of a person when walking or jogging.

Discussion of the Related Art

Numerous types of self-powered watercraft have been known for many years. As used herein, the term "self-powered" or "self-propelled" watercraft is a watercraft wherein the force of propulsion to move the watercraft across the surface of a body of water is generated entirely by one or more humans onboard the watercraft. In the past, others have proposed self-powered watercraft that are operated with the use of the arms of one or more occupants/operators of the watercraft. For example, rowboats of various types are well-known, wherein one or more occupants on board the rowboat pulls oars through the water using the arms, and core muscles, while also exerting force with the legs against a foot supporting structure. Others have proposed various peddle boats wherein the user operates peddles to move paddles below the watercraft in order to propel the watercraft across the water. Still others have proposed various watercraft wherein the user is able to standup while moving the legs back and forth, typically involving the user of two separate moving hulls, one for each leg.

While others have proposed watercraft that are propelled with the use of both arms and legs, they typically involve an elaborate arrangement of gears to translate the motion of structures moved by the arms and legs into a force that operates either a shaft with propellers or various paddle members. However, studies have shown that self-powered watercraft that use peddles, gears and other moving mechanisms lose at least 15% of energy just from friction and turning gears, belt drives, shafts and propellers.

Accordingly, there remains a need for a self-propelled watercraft that allows the user to more efficiently propel the watercraft through the water while in a standing position and with minimal effort, using the weight of the user's body while moving through a natural walking or jogging motion using both the arms and legs in a natural movement and pendulum gait.

SUMMARY OF THE INVENTION

The present invention is directed to a watercraft that utilizes the operator's full body weight in a standing position in order to propel the watercraft. The watercraft includes left and right hull members that are held in spaced apart, parallel relation by a supporting frame structure. A pendulum propulsion assembly mounts to the frame structure, between the hull members and includes left and right pendulum assemblies that are each moved in a forward and rear direction, in alternating fashion, by the operator's arms and legs. Each pendulum assembly includes at least a forward pendulum member that extends from an upper pivotal connection to a lower pivotal connection that connects to a horizontal pendulum plane. A paddle holder is mounted below the pendulum plane and supports an arrangement of spaced paddles that are normally at least partially submerged below the surface of the water during operation of the watercraft. Each foot of the operator rests on a foot well that is mounted on top of the pendulum plane. Left and right hand grips extend above the upper pivot point of the forward pendulum member. While grasping the hand grips and standing in the foot wells, operation of the left and right pendulum assemblies in the forward and reverse alternating action through a normal stride causes the paddles to propel the watercraft in a forward direction. Forward flexing of the paddles while in the forward propulsion stroke is limited by tethers connecting between the paddles and the paddle support. In a further embodiment, the watercraft can be engaged in forward and rear propulsion modes by engaging and disengaging forward and rear cables that limit either forward or rearward flexing of the paddles depending on the desired direction of propulsion.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
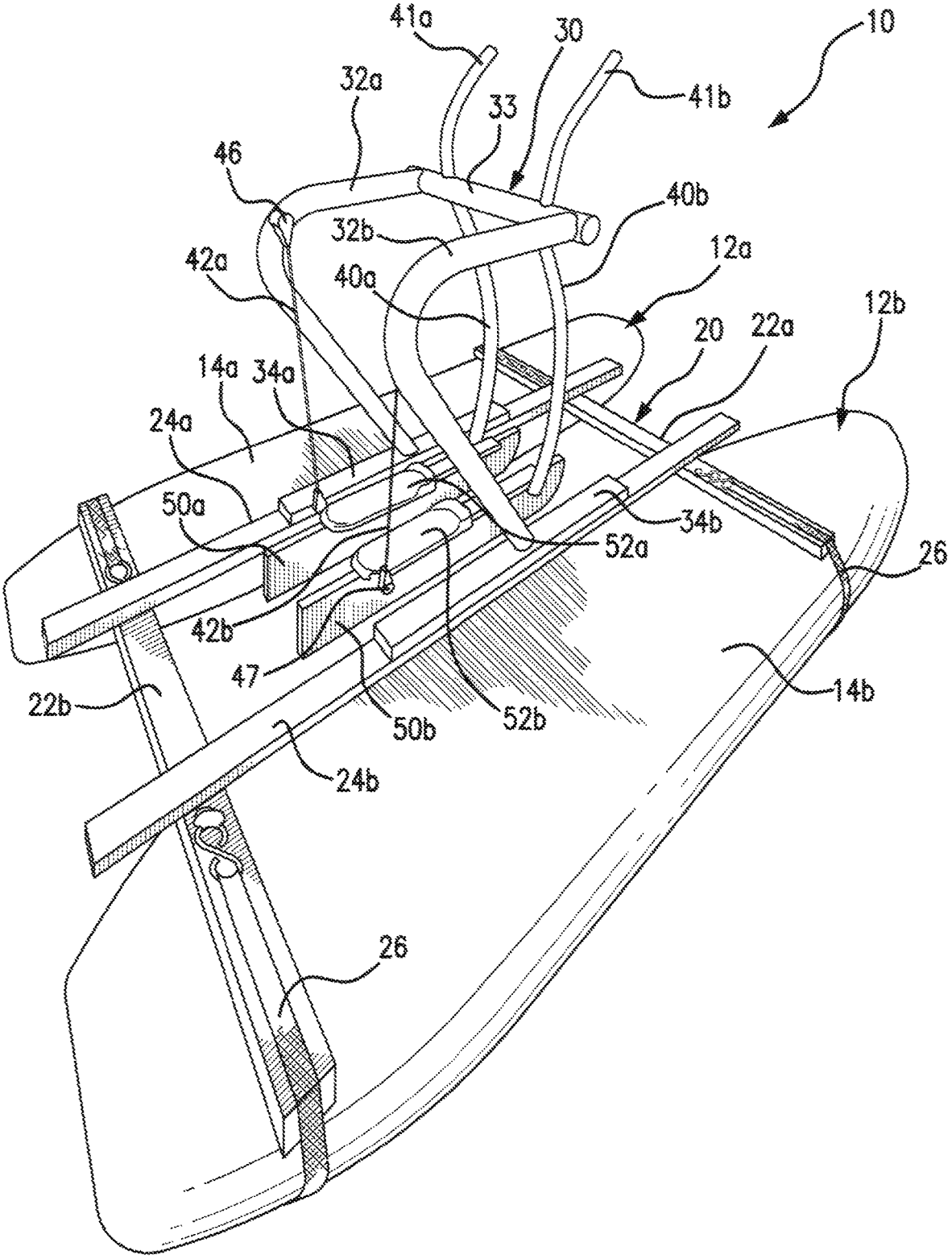
FIG. 1 is a rear, top perspective view of the self-propelled standup watercraft of the present invention.
Figure 2:
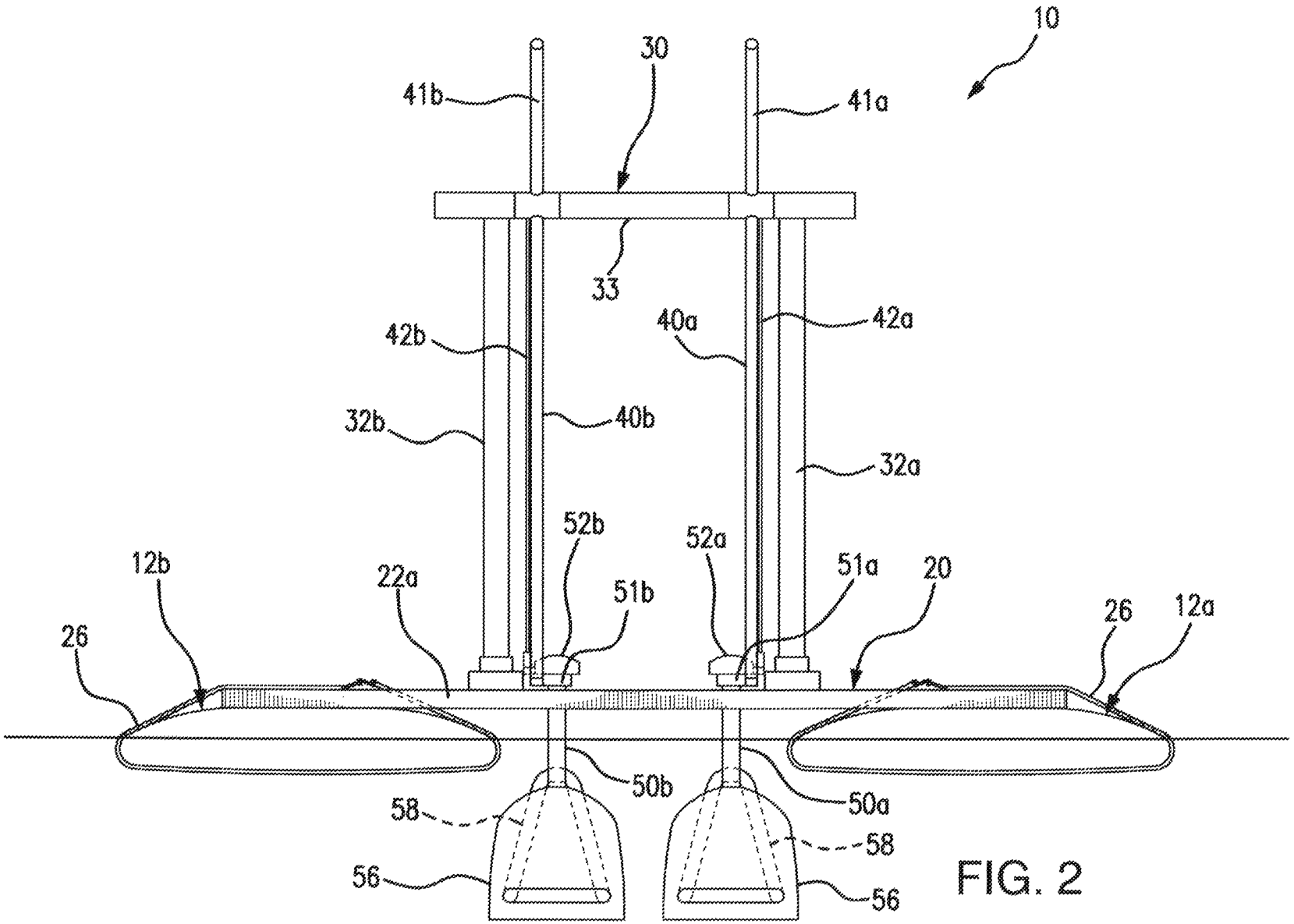
FIG. 2 is a front elevational view of the watercraft of FIG. 1.

The present invention is directed to a people powered watercraft that utilizes the operator's (paddler's) full body weight in a standing position. The watercraft is generally indicated as 10 throughout the several views of the drawings. Referring initially to FIGS. 1 and 2, the watercraft 10 includes hull members 12*a* and 12*b*. In one embodiment, the hull members are standup paddleboards or similar structures, much like a large surfboard. In other embodiments of the invention, the hull members may be formed to generally resemble catamaran hulls (i.e., pontoons), canoes or kayaks. As seen in FIGS. 1 and 2, the hull members 12*a* and 12*b* are secured in a manner that maintains the hull members in spaced, parallel relation to one another, leaving a gap between the hull members, similar to a catamaran. A frame structure 20 secures to the hull members 12*a*, 12*b* for holding the hull members in the spaced apart parallel position that allows the hull members to move across the surface of a body of water, partially submerged, as a unitary watercraft. As seen in FIGS. 1 and 2, the frame structure 20 mounts to the top surfaces 14*a*, 14*b* of the hull members. The frame structure includes a forward transverse frame member 22*a* and a rear transverse frame member 22*b* that mount to the top surfaces 14*a*, 14*b* of the hull members. The forward and rear transverse frame members are secured in place with straps 26 that extend around the hull members, as seen in FIG. 2. The frame structure 20 further includes left and right longitudinal frame members 24*a*, 24*b* that attach to the forward and rear frame members. The left and right longitudinal frame members extend in parallel relation to one another and are positioned to align generally with the inboard sides of the hull members, so that the gap between the hull members is between the left and right longitudinal frame members 24*a*, 24*b*.

A pendulum propulsion apparatus 30 is mounted to the left and right longitudinal frame members 24*a*, 24*b* and includes a pendulum support frame structure. The frame structure includes left and right pendulum support frame members 32*a*, 32*b* and a crossbar 33 that extends between the left and right pendulum support frame members. The pendulum support frame structure further includes left and right base frame members 34*a*, 34*b* that mount to the respective left and right longitudinal frame members 24*a*, 24*b*. The pendulum propulsion apparatus 30 further includes left and right pendulum propulsion assemblies that are vertically supported in side-by-side parallel relation to one another and between the left and right hull members 12*a*, 12*b*. The left and right pendulum propulsion assemblies include respective left and right forward propulsion members 40*a*, 40*b* that are pivotally coupled to the crossbar 33 at 44 (see FIGS. 3A-3C). The left and right upper portions of the forward pendulum members 40*a*, 40*b* extend above the crossbar 33 and provide handgrips 41*a* and 41*b*. The left and right pendulum propulsion assemblies further include respective left and right rear pendulum members 42*a*, 42*b* pivotally attached at upper ends at 46 to the left and right pendulum support frame members. The bottom ends of the left and right forward pendulum members 40*a*, 40*b* are pivotally attached to pendulum planes 51*a*, 51*b* at 45. The lower ends of the left and right rear pendulum members 42*a*, 42*b* are pivotally attached to the pendulum planes 51*a*, 51*b* at 47, see FIGS. 3A-3C.

Figure 3C:
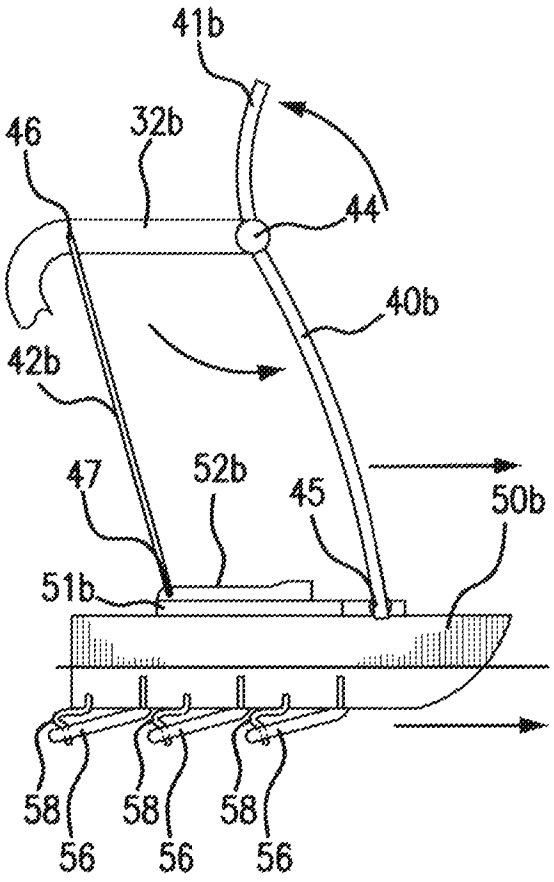
FIGS. 3A-3C illustrate a sequence of movement of the pendulum propulsion assembly of the present invention from a rest position to a power stroke and a recovery stroke.
Figure 3B:
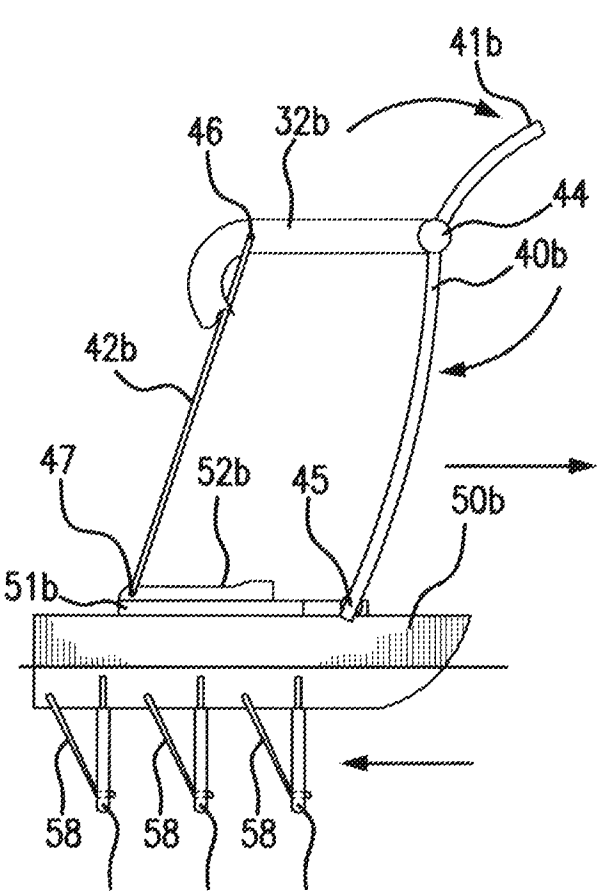
Figure 3A:
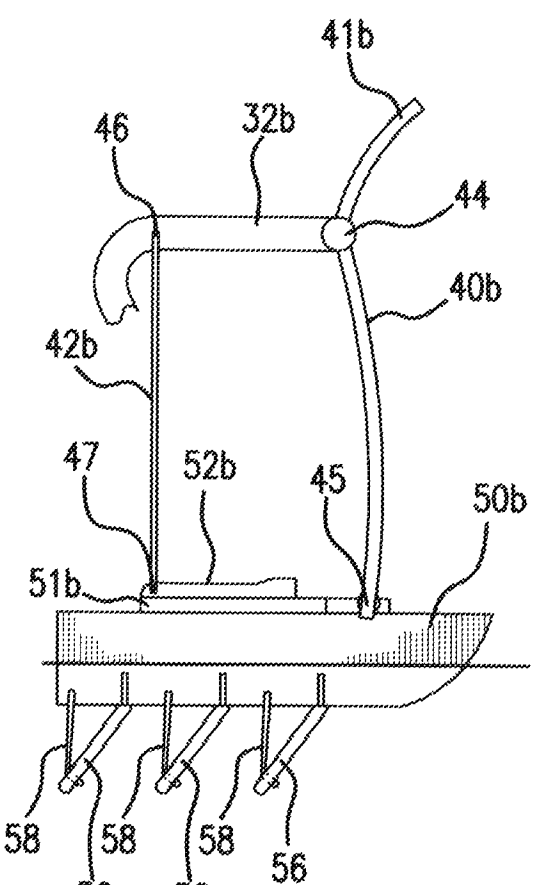

Each of the left and right pendulum propulsion assemblies further include left and right paddle holders 50*a*, 50*b* attached to a bottom of the pendulum planes 51*a*, 51*b*. Left and right foot wells 52*a*, 52*b* are mounted to the top of the pendulum planes. Each of the left and right pendulum propulsion assemblies further include an arrangement of spaced apart paddles 56 fitted to the bottom of the left and right paddle holders 51*a*, 51*b*. The paddles are preferably formed of a flexible rubber material and, in at least one embodiment, are held by tethers 58 (coated wire or heavy gauge monofilament) that pass through spaced apart apertures near lower ends of the paddles and connect to the respective left and right paddle holders. The tethers 58 limit forward flexing of the paddles 56 beyond a 90 degree angle relative to the bottom side of the paddle holders 51*a*, 51*b* during the power stroke (i.e., forward propulsion stroke), as seen in FIG. 3B, and the tethers allow the paddles 56 to flex backwards and collapse upwardly during the return stroke, as seen in FIG. 3C.

In use, each foot of the operator rests on one of the foot wells 52*a*, 52*b* mounted on the respective pendulum plane 51*a*, 51*b*. The pendulum plane is a rigid, generally horizontal frame member that joins the two pendulum members (i.e., forward pendulum member and rear pendulum member) as a single pendulum bob. The pendulum plane is supported by the two pendulum members that are each attached to the respective upper pivot points. The pendulum plane (or pendulum bob) has connecting bolts which join the two pendulum members (forward and rear pendulum members) approximately 20-24 inches apart at the lower pivot elements. This allows space for the foot wells 52*a*, 52*b* and adequate space to avoid interfering with the operator's legs during pendulum swings. The pendulum plane 51*a*, 51*b*, supported by both the forward pendulum member 40*a*, 40*b* and the rear pendulum member 42*a*, 42*b*, allows the operator's feet to stay more horizontal during the pendulum arc swing as the operator moves in a natural gait (walking or jogging action).

The level pendulum plane helps to keep the paddle holder more horizontal than a fixed bob on a single pendulum. The paddles 56, secured to the bottom of the paddle holder 50*a*, 50*b* also stay more horizontal, thereby allowing the paddles 56 to engage the water in a more uniform fashion and for a longer duration. The forward pendulum member 40*a*, 40*b* of each of the pendulum propulsion assemblies (i.e., left and right) is of a sturdy rigid material with a portion that extends above the pendulum pivot point 44. This upper pendulum portion has the hand grips 41*a* and 41*b* that are angled forward to allow the operator's hands to mimic natural hand positions while running. This assists in uniform gripping with each finger for the duration of the pendulum swing. The rearward pendulum members 42*a*, 42*b* have no portion that extends above the pendulum pivot point 46.

Figures 5A, 5B, 5C:
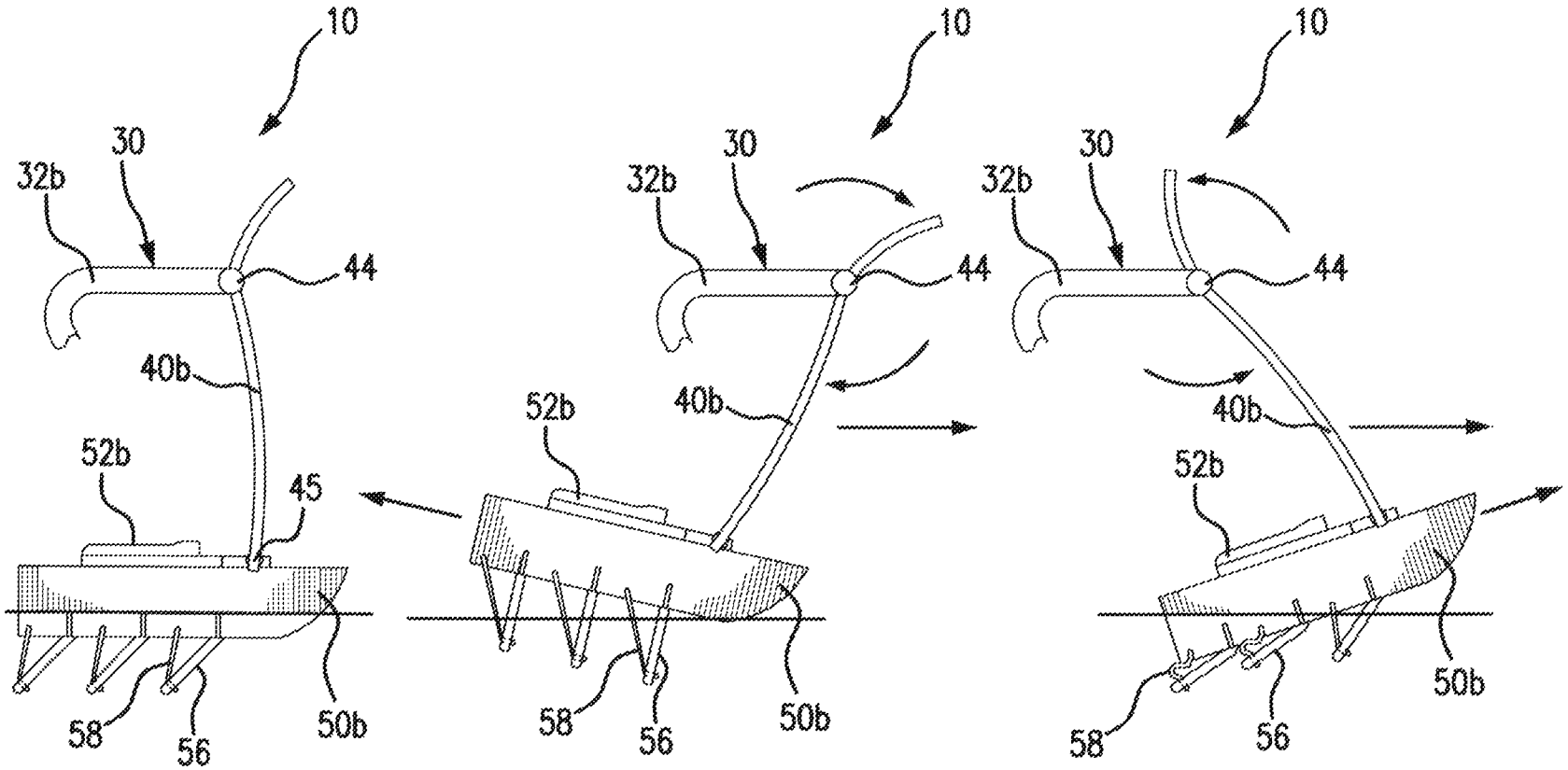
FIGS. 5A-5C illustrate a sequence of operation of an alternative embodiment of the propulsion assembly directed to a single pendulum arrangement for both left and right pendulum propulsion assemblies, and showing a sequence of movement of the single pendulum propulsion assembly from a rest position, to a power stroke and a recovery stroke.

Since the operator is in a standing position with their full weight on the foot wells 52*a*, 52*b* of the left and right pendulum propulsion assemblies, the operator is able to maintain a fluid gait as in walking or running. Each paddle holder 50*a*, 50*b* is hydro-dynamically shaped to cut through the water, minimizing resistance during the forward swing of the pendulum, or recovery stroke (see FIGS. 3C and 5C). The arrangement of spaced paddles 56 attached to the bottom of each paddle holder are able to flex or fold horizontally during the recovery stroke to also minimize resistance in the water. The rear end of the paddle holders 50*a*, 50*b* need not be hydro-dynamically shaped for movement in the rearward ("catch" or "power") stroke. The paddles in the propulsion stroke (power stroke) should quickly "catch" water prior to operator using full power of their weight.

The paddles may be secured with coated wire or heavy monofilament (i.e., tethers) so that when they do catch water they do not extend past 90° angle to maintain resistance to water. One embodiment contemplates use of four paddles with the rear paddle (which catches water first) at 45° angle, the next paddle at a 60° angle, the next at a 75° angle and the forward paddle and 90° angle. Since the paddles for propulsion are flexible, the watercraft is able to operate in water as shallow as 4 inches.

The frame structure that secures the hull members 12*a*, 12*b* may also have slots to place dagger boards so the hull members 12*a*, 12*b* may not need fins. This allows operation in very shallow water without the dagger board in place. Use of dagger boards helps reduce downwind slippage or leeway. A large commercially available cooler may be mounted atop the hull members 12*a*, 12*b* and secured to both the securing frame structure and the pendulum frame structure. This will ease boarding the watercraft from a dock or higher surface on land. It also can be used as a seat for passengers. Lounge chairs may be mounted atop the hull members for passenger comfort and relaxation. The hull securing frame structure or the pendulum frame structure may support a top for shade from sunlight. The pendulum frame structure may have cup holders, radio, dry storage, holders for traditional paddles, or fishing rod holders. Moreover, the watercraft may support a system to install a fixed wing sail that can be moved to either side of craft.

Figure 4:
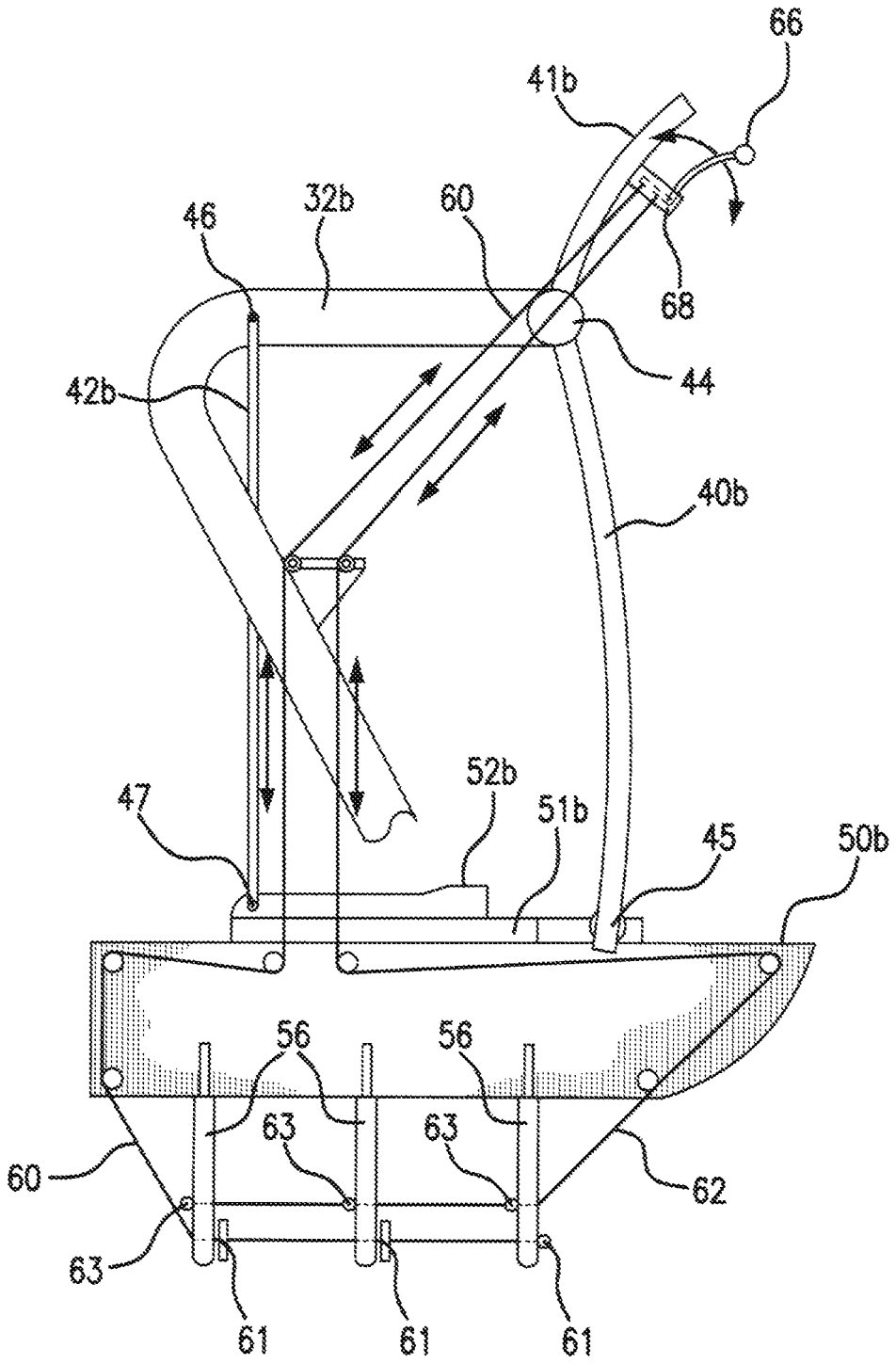
FIG. 4 is an isolated side elevational view of a further embodiment of the present invention showing a forward and reverse control assembly for selectively operating the pendulum propulsion assembly in either forward propulsion or rearward propulsion.

Referring to FIG. 4, a further embodiment of the invention is illustrated schematically to show both a forward and reverse directional control of the watercraft 10. Specifically, this embodiment provides for both a forward propulsion cable 60 and a separate rearward propulsion cable 62. Both the forward and rearward propulsion cables 60, 62 are engaged with the paddles 56 below the paddle holders 50*a*, 50*b* of each of the left and right pendulum propulsion assemblies. The forward propulsion cable includes stop members 61 that engage a front facing side of the paddle 56 so that when the stop members 61 are engaged with the front face of the paddles 56, the paddles are not able to flex beyond 90 degrees in the forward direction when the forward propulsion cable is engaged and the paddle holder moves back through the water in a forward propulsion power stroke. Similarly, the rearward propulsion cable 62 includes stop members 63 that engage a rear facing side of each of the paddles 56 so that the paddles are not able to flex beyond 90 degrees in the rearward direction when the rearward propulsion cable 62 is engaged (and forward propulsion cable is disengaged) and the paddle holders 50*a*, 50*b* are moving in a rearward propulsion stroke. A control 66 near the hand grips 41*a*, 41*b* allows for engagement and disengagement of the forward and rearward propulsion cables to selectively operate the watercraft in either the forward direction or the rearward direction. The control 66 is linked to a lever mechanism 68 that is moved by the control 66 to disengage one of the forward or rearward propulsion cables while engaging the other propulsion cable. Specifically, when it is desired to move in the forward direction, the control 66 is operated to disengage the stop members 63 on the rearward propulsion cable from the paddles 56, thereby allowing the paddles 56 to collapse in the recovery stroke while preventing the paddles from flexing beyond 90 degrees in the forward propulsion stroke. When it is desired to move the watercraft in the rearward direction, the control 66 is operated to disengage the stop members 61 on the forward propulsion cable from the front sides of the paddles, while engaging the stop members 63 with the rear side of the paddles, thereby allowing the paddles 56 to collapse forwardly when moving the paddle holders 50*a*, 50*b* in the rearward propulsion recovery stroke.

It is further contemplated to incorporate a steering system on the watercraft 10 for turning the watercraft while moving across the surface of a body of water. The steering system could include any of well-known rudder systems that can be operatively linked to a steering control on the pendulum support frame structure.

The minimal resistance of this pendulum propulsion system of the present invention is optimal as a more efficient system of propulsion. Studies have indicated that manually powered watercraft that have pedals and gears lose at least 15% of energy just from friction in turning gears, drive belts, and shafts with propellers. This pendulum propulsion system of the present invention has very little wasted resistance as it drives water directly via paddle flappers and can approach 94% efficient use of people power to drive craft forward. Since two tandem pendulum propulsion assemblies are operating in alternating action, there is nearly continual propulsion. It is estimated that time of no propulsion force being exerted by the paddles during normal operation is less than 7%, thereby improving efficiency over gear turning human powered watercraft. This may allow the watercraft of the present invention to be faster than other pedal watercrafts, while requiring less physical energy of the operator.

While the present invention has been shown and described in accordance with several preferred and practical embodiments, it is recognized that departures from the instant disclosure are fully contemplated within the spirit and scope of the present invention which is not to be limited except as defined in the following claims as interpreted under the Doctrine of Equivalents.

What is claimed is:

1. A watercraft comprising:

at least two elongate hull members including a left hull member and a right hull member;

a frame structure for removable attachment to the at least two hull members for holding the left and right hull members in spaced apart relation to one another;

a pendulum propulsion apparatus including a left pendulum propulsion assembly and a right pendulum propulsion assembly, the left and right pendulum propulsion assemblies maintained in parallel relation to one another and between the left and right hull members, and each of the left and right pendulum propulsion assemblies including:

a forward pendulum member movable about an upper pivot axis and including a handgrip above the upper pivot axis and a lower portion extending below the upper pivot axis and terminating at a bottom end;

a rigid planar member pivotally coupled to the lower portion of the forward pendulum member adjacent to the bottom end;

a paddle holder attached to a bottom side of the rigid planar member and structured and disposed to be partially submerged below a surface of a body of water and between the left and right hull members when the watercraft is floating on the surface of the body of water;

an arrangement of flexible paddles extending downwardly from the paddle holder at spaced intervals;

a foot supporting member on the top of the rigid planar member; and whereby alternating and repeated movement of the left and right pendulum propulsion assemblies in forward and rearward directions about the upper pivot axis by a person on the watercraft using at least the person's legs or arms causes the arrangement of flexible paddles to be forced against the body of water below the surface to propel the watercraft across the surface.

2. The watercraft as recited in claim 1 wherein each of the left and right pendulum propulsion assemblies further comprise:

a rear pendulum member movable about a rear upper pivot axis and pivotally coupled to the rigid planar member at a bottom end.

3. The watercraft as recited in claim 1 further comprising:

tethers secured to each of the paddles and the paddle holders for limiting forward flexing of the paddles during a power stroke when the paddles and the paddle holders are moved in a rearward direction to propel the watercraft forward across the surface of the body of water.

4. The watercraft as recited in claim 3 wherein the paddles are structured and disposed to flex and collapse rearwardly and upwardly in a recovery stroke when the paddles and paddle holders are moved in a forward direction through the water.

5. The watercraft as recited in claim 1 wherein the pendulum propulsion apparatus further comprises:

a pendulum support frame structure including at least a left pendulum support frame member and a right pendulum support frame member, and the pendulum support frame structure being structured and disposed for supporting the left and right pendulum propulsion assemblies.

6. The watercraft as recited in claim 1 further comprising:

a forward and reverse directional propulsion system including:

a control mechanism for engaging and disengaging both a forward directional propulsion mode and a rear directional propulsion mode;

a forward propulsion cable connected to the control mechanism and extending to the arrangement of paddles and including stop members engaging front sides of the paddles to limit forward flexing of the paddles during a power stroke wherein the paddles and paddle holder are moved in a rear direction to propel the watercraft forward across the surface of the body of water;

a rearward propulsion cable connected to the control mechanism and extending to the arrangement of paddles and including stop members for engaging the back sides of the paddles for limiting rear flexing of the paddles wherein the paddles and paddle holder are moved in a rear directional power stroke in a rearward direction through the water; and whereby operation of the control mechanism serves to selectively engage the stop members on the forward propulsion cable with the arrangement of paddle members while simultaneously disengaging the stop members on the rear directional cable with the paddles for operating the watercraft in a forward propulsion direction and further wherein the control mechanism is selectively operated to engage the stop members on the rearward propulsion cable with the arrangement of paddles while simultaneously disengaging the stop members on the forward directional cable with the arrangement of paddles when operating the watercraft in a rear propulsion direction of movement.

* * * * *